US005718010A

United States Patent [19]

Beier

[11] Patent Number: 5,718,010

[45] Date of Patent: Feb. 17, 1998

[54] PILLOW WITH COLLAR

[75] Inventor: Michael B. Beier, Omaha, Nebr.

[73] Assignee: Products Unlimited, Inc., Omaha, Nebr.

[21] Appl. No.: 783,225

[22] Filed: Jan. 14, 1997

[51] Int. Cl.[6] ..... A47G 9/02; G09F 3/10

[52] U.S. Cl. ..... 5/636; 5/640; 5/907; 40/638; 40/299

[58] Field of Search ..... 5/636, 907, 490, 5/640, 482; 40/630, 638, 310, 299

[56] References Cited

U.S. PATENT DOCUMENTS

| | | | |
|---|---|---|---|
| 4,309,784 | 1/1982 | Cohen | 40/661 X |
| 4,312,523 | 1/1982 | Haines | 40/630 |
| 4,661,198 | 4/1987 | Fumei | 40/638 X |
| 5,070,558 | 12/1991 | Fenley | 5/636 |
| 5,584,086 | 12/1996 | VanWinkle et al. | 5/640 X |

OTHER PUBLICATIONS

Brochure—Aug. 30, 1988—Picture of pillow.

*Primary Examiner*—Michael F. Trettel
*Attorney, Agent, or Firm*—Zarley,McKee,Thomte,Voorhees & Sease; Mark D. Frederiksen

[57] ABSTRACT

A pillow with advertising collar includes an elongated pillow having enlarged ends and a smaller diameter central portion with a generally cylindrical collar encircling the central portion and having printed indicia on an outward face thereof. The collar has a diameter greater than the central portion but less than the ends of the pillows, thereby retaining the collar in position on the pillow.

16 Claims, 1 Drawing Sheet

PILLOW WITH COLLAR

TECHNICAL FIELD

The present invention relates generally to pillows, and more particularly to an advertising label in the form of a collar attached to a pillow.

BACKGROUND OF THE INVENTION

Pillows for supporting the head and/or neck of a person in a reclined position commonly have tags attached along a seam, listing materials, manufacturer, and various advertising, including trademarks and the like. Other common methods for advertising conventional pillows include the use of a bag completely encasing the pillow, the bag having advertising imprinted thereon.

With the introduction of the bone-shaped pillow-an elongated pillow having enlarged ends and a tapered reduced diameter central portion, in the shape of a bone-conventional advertising methods were found to be inadequate and aesthetically unappealing.

SUMMARY OF THE INVENTION

It is therefore a general object of the present invention to provide an improved pillow with an advertising label connected thereto. Yet another object is to provide a collar for a bone-shaped pillow which is aesthetically pleasing in appearance and simple to manufacture.

Still another object of the present invention is to provide a pillow with an advertising collar which is simply and easily attached to the pillow, but is also easily removed without marking the pillow.

These and other objects of the present invention will be apparent to those skilled in the art.

The pillow with advertising collar of the present invention includes an elongated pillow having enlarged ends and a smaller diameter central portion with a generally cylindrical collar encircling the central portion and having printed indicia on an outward face thereof. The collar has a diameter greater than the central portion but less than the ends of the pillows, thereby retaining the collar in position on the pillow.

DESCRIPTION OF THE PREFERRED EMBODIMENT

Figure 1:
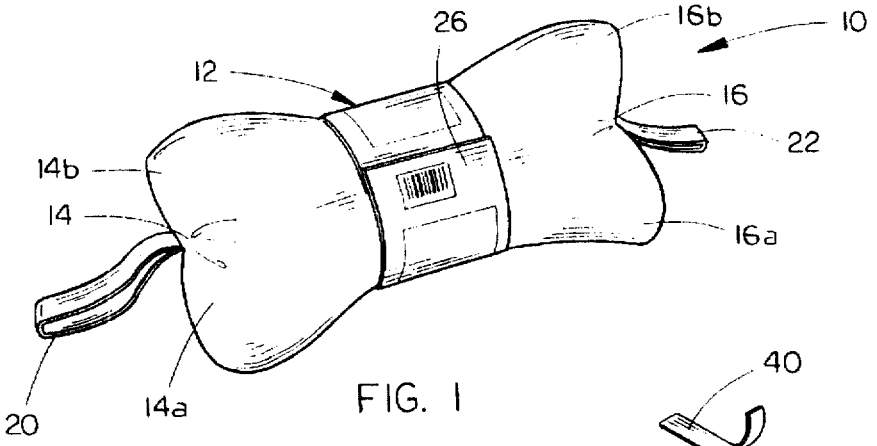
FIG. 1 is a perspective view of a pillow with the advertising collar of the present invention attached thereto.

Referring now to the drawings, in which similar or corresponding parts are identified with the same reference numeral and more particularly to FIG. 1, the present invention includes a pillow designated generally at 10 with an advertising collar 12 removably attached thereto.

Figure 2:
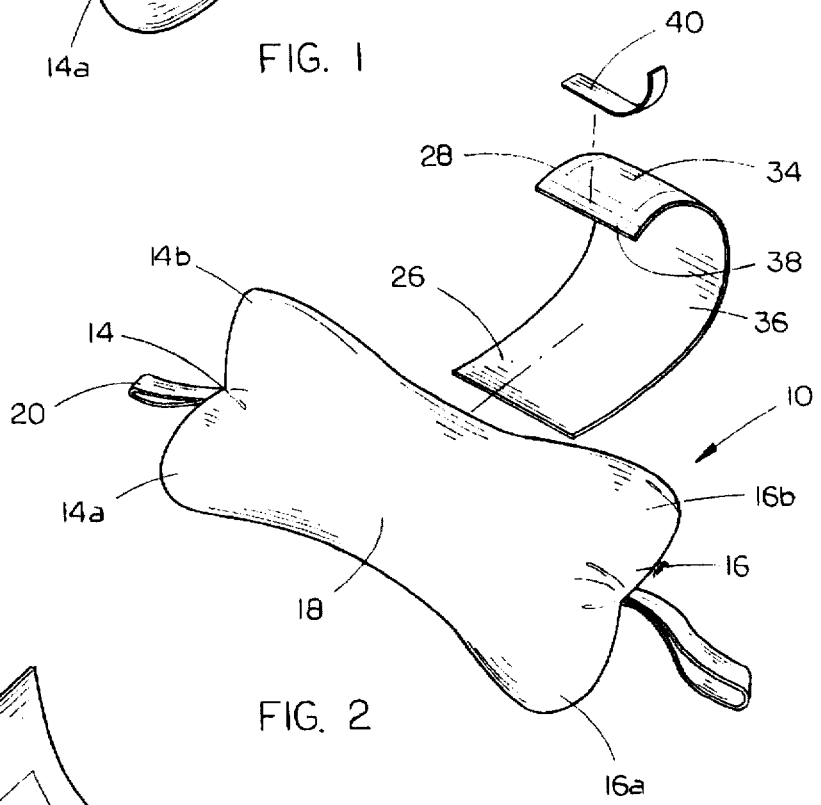
FIG. 2 is a perspective view of a pillow with the collar removed in an exploded position therefrom.

Pillow 10 is an elongated fabric covered pillow having opposing first and second ends 14 and 16. A central portion 18 of pillow 10 is located between first and second ends 14 and 16 and is generally cylindrical in shape, with a diameter less than the diameters of both ends 14 and 16, as shown in FIG. 2.

In the preferred form of the invention, pillow 10 has lobes formed in each end thereof, designated as lobes **14*a* and 14*b* in first end 14, and lobes 16*a* and 16*b* on second end 16. Lobes 14*a*, 14*b*, 16*a*, and 16*b* are shaped to represent the appearance of a bone in pillow 10. Obviously, while two lobes are shown in the drawing on each end, three or more lobes could also be used to enhance this appearance. In addition, ends 14 and 16 could be non-lobed, with a cylindrical, tapered, or spherical shape, so long as the ends have a diameter greater than central portion 18**.

A first strap 20 is attached to the first end 14 of pillow 10 in the form of a loop, to form a handle on one end of pillow 10. A second strap 22 is attached to pillow second end 16, and is also formed in a loop to form a handle.

Figure 3:
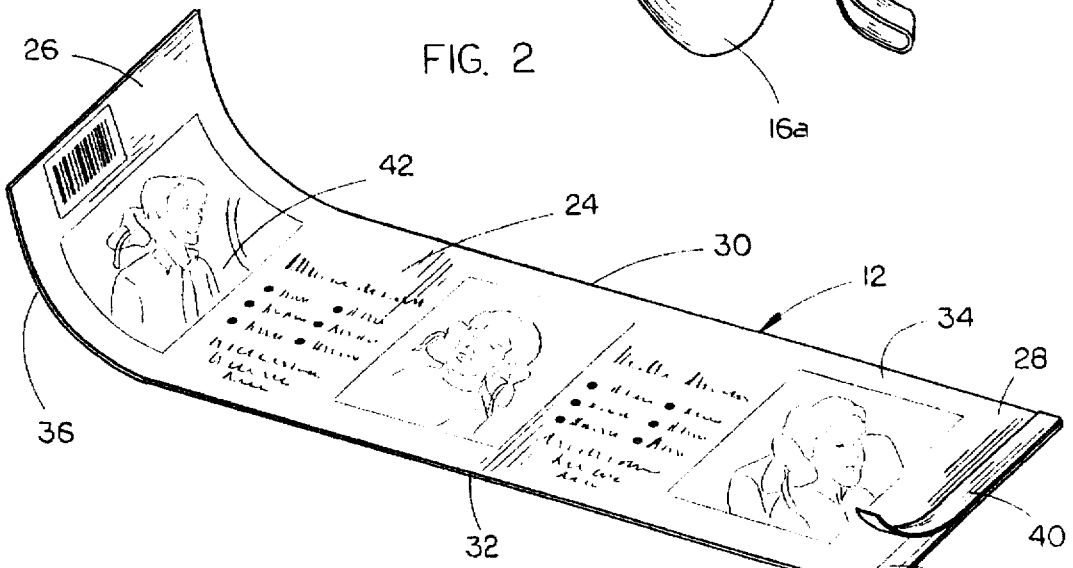
FIG. 3 is an enlarged perspective view of the advertising collar of the present invention.

Referring now to FIG. 3, collar 12 is formed from an elongated rectangular sheet 24 of a paper or cardboard material. Obviously, cloth or other fabric, plastic, or other materials may also be utilized instead of the preferred paper product. Sheet 24 includes first and second ends 26 and 28 opposing longitudinal side edges 30 and 32 and front and back faces 34 and 36. A strip of adhesive 38 is formed on the front face 34 along the second end 28 of sheet 24, and has a backing strip 40 removably attached thereto to prevent adherence of the adhesive until collar 12 is in the desired position. As shown in FIG. 3, various printed indicia 42 is imprinted on the front face 34 of sheet 24.

Referring once again to FIG. 2, collar 12 is mounted to pillow 10 by wrapping sheet 24 around central portion 18 with the back face 36 in contact with pillow 10. Backing strip 40 is removed from adhesive strip 38, and the back face 36 of second end 26 is overlapped onto the adhesive strip 38, and pressed into adhering contact therewith to form a cylindrical collar, as shown in FIG. 1. Collar 12 is a diameter which is slightly greater than the diameter of central portion 18 of pillow 10, but less than the diameters of the pillow ends 14 and 16, to slidably retain collar 12 in position on the pillow. Collar 12 may be removed by tearing the collar, cutting the collar, or unfastening the sheet end 26 from the adhesive. In this way, no punctures or other direct contact is made with the pillow to retain the advertising collar in position.

Whereas the invention has been shown and described in connection with the preferred embodiment thereof, many modifications, substitutions and additions may be made which are within the intended broad scope of the appended claims.

I claim:

1. In combination:

an elongated pillow having first and second ends and a central portion between the ends;

said central portion having a diameter measured orthogonal to a longitudinal axis of the pillow, the central portion diameter less than a diameter of each of the first and second ends; and a generally cylindrical collar encircling the central portion of the pillow, said collar independent of the pillow and having a diameter less than that of the pillow first and second ends;

said pillow formed with the central portion diameter less than the diameter of the collar, such that the pillow does not expand radially outwardly against the collar.

2. The combination of claim 1, wherein said pillow gradually tapers in diameter from the ends to the central portion.

3. The combination of claim 1, wherein each said pillow end includes at least two outwardly projecting lobe portions.

4. The combination of claim 1, wherein the first and second ends are symmetric.

5. The combination of claim 1, wherein the first and second ends are identical.

6. In combination:

an elongated pillow having first and second ends and a central portion between the ends;

said central portion having a diameter measured orthogonal to a longitudinal axis of the pillow, the central portion diameter less than a diameter of each of the first and second ends; and a generally cylindrical collar encircling the central portion of the pillow, said collar independent of the pillow and having a diameter greater than that of the central portion but less than that of the pillow first and second ends;

wherein said collar is formed of an elongated sheet having first and second ends connected together to form a generally cylindrical shape.

7. The combination of claim 6, wherein said sheet is formed of a paper stock material.

8. The combination of claim 7, wherein said sheet includes a front face and opposing back face, and wherein said collar is fastened to the pillow with the back face facing the central portion and the front face facing outwardly therefrom, said front face having indicia printed thereon.

9. The combination of claim 8, wherein said pillow gradually tapers in diameter from the ends to the central portion.

10. The combination of claim 9, wherein each said pillow end includes at least two outwardly projecting lobe portions.

11. The combination of claim 10, wherein the first and second ends are symmetric.

12. The combination of claim 11, wherein the first and second ends are identical.

13. The combination of claim 6, wherein said sheet includes a front face and opposing back face, and wherein said collar is fastened to the pillow with the back face facing the central portion and the front face facing outwardly therefrom, said front face having indicia printed thereon.

14. A method for attaching printed indicia to a pillow, comprising the steps of:

providing a generally cylindrical collar having a front face with printed indicia thereon, and a back face;

encircling the collar about a central portion of a pillow.

15. The method of claim 14, wherein the pillow is elongated with first and second ends, wherein the first and second ends have diameters greater than a diameter of the central portion, and wherein the step of providing a collar includes providing a collar with a diameter greater than the central portion but less than diameters of the pillow ends.

16. The method of claim 15, wherein the step of encircling the collar about the pillow includes:

said collar being formed of an elongated sheet having first and second ends;

orienting the sheet with the back face around and in contact with the central portion of the pillow; and fastening the first and second ends of the sheet together to form a generally cylindrical collar.

* * * * *